US010415929B2

(12) United States Patent
Hurley

(10) Patent No.: US 10,415,929 B2
(45) Date of Patent: Sep. 17, 2019

(54) BREAKDOWN RIFLE HOLDER FOR TRANSPORT AND STORAGE

(71) Applicant: Bryan Hurley, Mount Dora, FL (US)

(72) Inventor: Bryan Hurley, Mount Dora, FL (US)

( * ) Notice: Subject to any disclaimer, the term of this patent is extended or adjusted under 35 U.S.C. 154(b) by 2 days.

(21) Appl. No.: 15/935,380

(22) Filed: Mar. 26, 2018

(65) Prior Publication Data

US 2018/0274884 A1 Sep. 27, 2018

Related U.S. Application Data

(60) Provisional application No. 62/476,146, filed on Mar. 24, 2017.

(51) Int. Cl.

| | |
|---|---|
| ***F41C 33/06*** | (2006.01) |
| ***F41A 3/66*** | (2006.01) |
| ***F41A 35/00*** | (2006.01) |
| *F41A 11/00* | (2006.01) |

(52) U.S. Cl.

CPC ..... *F41C 33/06* (2013.01); *F41A 3/66* (2013.01); *F41A 35/00* (2013.01); *F41A 11/00* (2013.01)

(58) Field of Classification Search

CPC .. F41C 33/06; F41A 3/66; F41A 35/00; F41A 11/00; F41A 11/04

USPC ..... 42/90, 108, 106; 211/64

See application file for complete search history.

(56) References Cited

U.S. PATENT DOCUMENTS

| | | | | |
|---|---|---|---|---|
| 873,786 | A | 12/1907 | Reutar | |
| 2,531,550 | A | 11/1950 | Bradley et al. | |
| 4,115,943 | A | 9/1978 | Musgrave | |
| 6,009,996 | A | 1/2000 | Purdy | |
| 6,540,092 | B2 * | 4/2003 | Sirois | F41A 23/18 211/64 |
| 7,025,203 | B2 | 4/2006 | Schonenbach | |
| D587,051 | S | 2/2009 | Vining | |
| D643,658 | S | 8/2011 | Vining | |
| 8,025,193 | B1 * | 9/2011 | Gornall, Jr. | A45F 5/00 224/268 |
| 8,209,896 | B1 * | 7/2012 | Cashwell | F41A 23/18 206/317 |

(Continued)

OTHER PUBLICATIONS

Ruger, Ruger SR-556 Takedown, Ruger Mark IV Product Safety Warning and Recall Notice, 2017 Sturm, Ruger & Co. Inc., http://www.ruger-firearms.com/products/sr556TD/models.html.

(Continued)

*Primary Examiner* — Samir Abdosh

(74) *Attorney, Agent, or Firm* — Matthew G. McKinney, Esq.; Allen, Dyer et al.

(57) ABSTRACT

A breakdown rifle holder for transport and storage includes an upper body having an upper surface, where the upper surface is configured to slide into an upper receiver of a rifle. The holder also includes a lower body having a first end and a second end, where the first end is connected to a lower surface of the upper body and extends perpendicularly away from the lower surface of the upper body and forms an "L" shape. The second end of the lower body is configured to slide into a lower receiver of the rifle and retain the lower receiver by friction fit. In addition, a magazine receiver is connected to the lower surface of the upper body adjacent to the lower portion, where the magazine receiver is configured to receive an open end of a magazine and retain the magazine by friction fit.

20 Claims, 3 Drawing Sheets

(56) References Cited

U.S. PATENT DOCUMENTS

| | | | |
|---|---|---|---|
| 8,322,068 | B2 | 12/2012 | Wilson |
| 8,578,645 | B2 | 11/2013 | Cauley |
| 8,656,626 | B1 | 2/2014 | McCamley |
| 8,931,201 | B2 | 1/2015 | Gianladis et al. |
| D794,979 | S | 8/2017 | Centracchio |
| 2012/0222344 | A1 | 9/2012 | Werner |
| 2018/0023924 | A1 | 1/2018 | Storch |

OTHER PUBLICATIONS

Magpul, Bev Block—AR15/M4 Product Details, catalog, 2017 Magpul Industries Corp., https://www.magpul.com/products/firearms-accessories/tools/bev-block-ar15-m4.

PlastiXrevolution (/), AR-15 Upper & Lower Vise Block Combo, catalog, 2017 PlastiXrevolution (/), https://www.plastixrevolution.net/products/basic-upper-lower-vise-block-combo.

* cited by examiner

FIG. 1
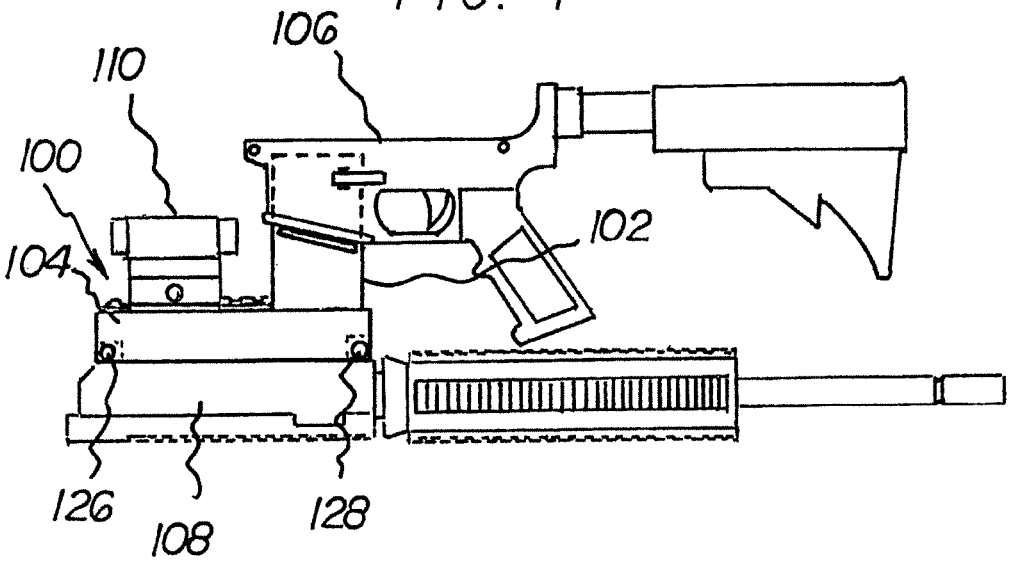
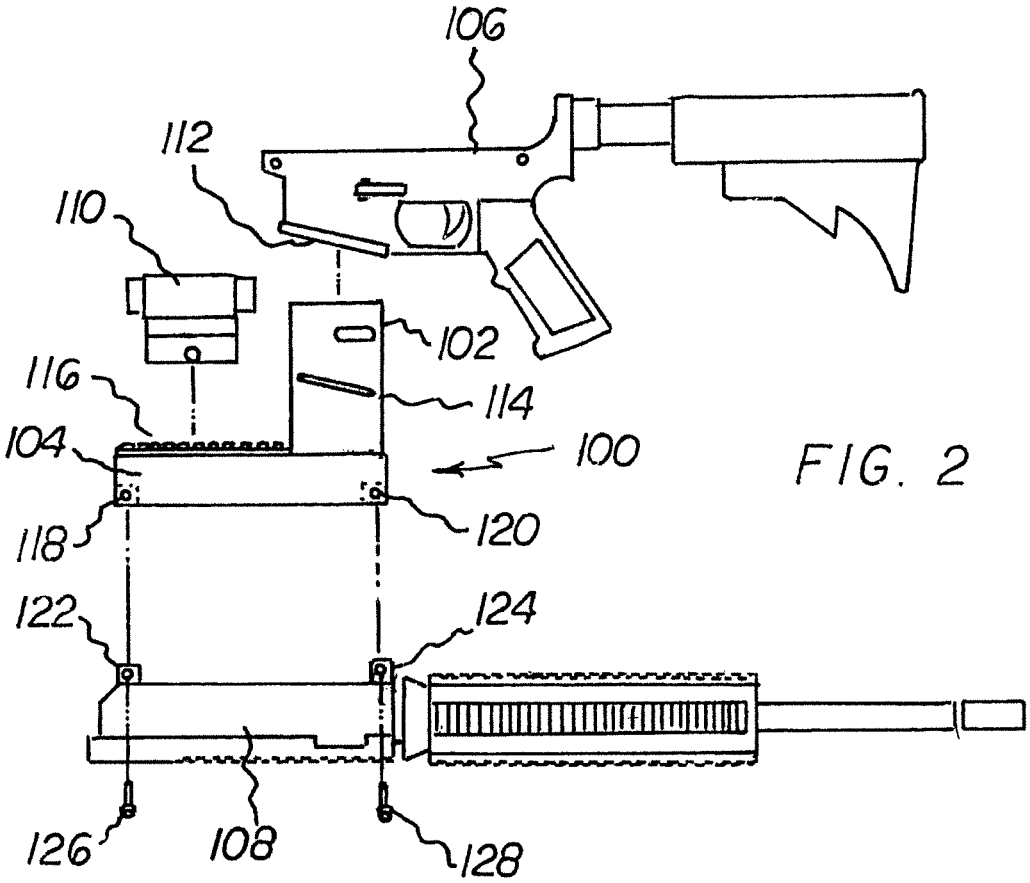
FIG. 2

FIG. 5
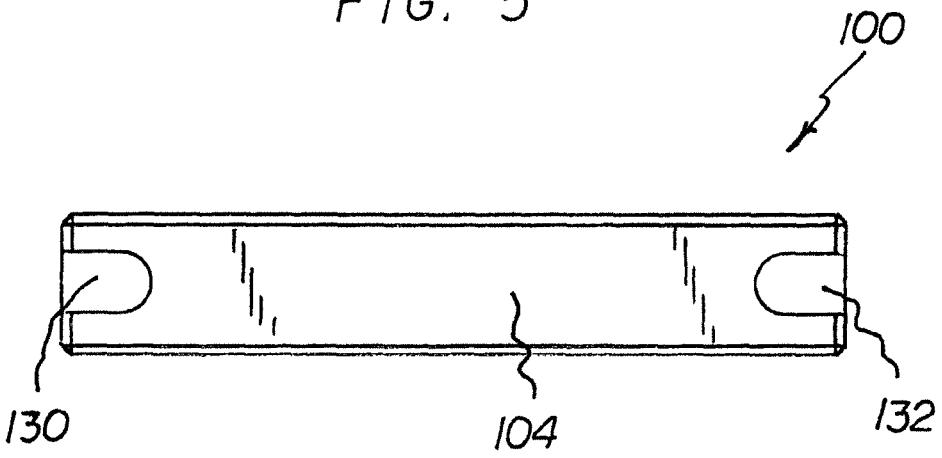
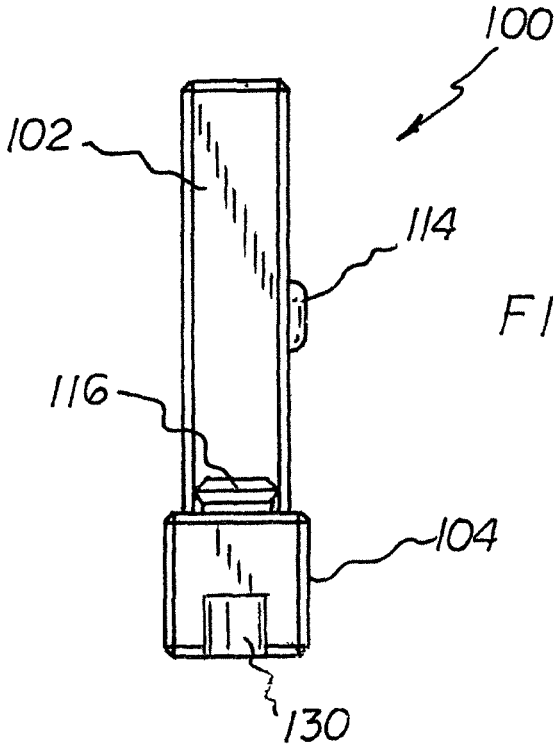
FIG. 6

BREAKDOWN RIFLE HOLDER FOR TRANSPORT AND STORAGE

RELATED APPLICATION

The present invention is related to U.S. Provisional Patent Application Ser. No. 62/476,146 filed Mar. 24, 2017, the entire contents of which are incorporated herein by reference.

FIELD

The present invention relates to the field of firearms, and more particularly, to a breakdown rifle holder for transport and storage.

BACKGROUND

Gun cases for firearms are generally used for storage and transport. Generally, such cases protect the firearm from dust and dirt, and may be at least somewhat moisture resistant. However, gun cases cannot fully protect the firearm during transport, and the firearm may be damaged or ruined if carelessly handled. This is particularly true when the firearm is a rifle that is broken down for transport and stored within the gun case. Accordingly, a need exists for an improved device for the transporting and storing of firearms.

SUMMARY

In view of the foregoing background, it is therefore an object of the present invention to provide a breakdown rifle holder for transport and storage. The breakdown rifle holder includes an upper body having an upper surface and first and second notches formed therein on opposing ends thereof. The upper surface is configured to slide into an upper receiver of a rifle, and the first and second notches each are configured to receive a respective tab extending from the upper receiver.

The holder also includes a lower body having a first end and a second end, where the first end is connected to a lower surface of the upper body and extends perpendicularly away from the lower surface of the upper body and forms an "L" shape. The second end of the lower body is configured to slide into a lower receiver of the rifle and retain the lower receiver by friction fit. In addition, a magazine receiver is connected to the lower surface of the upper body adjacent to the lower portion, where the magazine receiver is configured to receive an open end of a magazine and retain the magazine by friction fit.

A first aperture and a second aperture are formed completely through the upper body and through the first and second notches, respectively, of the upper body. A first pin and a second pin are configured to slide through the first and second apertures and through first and second tab apertures aligned with the first and second apertures, respectively, to secure the upper receiver to the upper body.

Other aspects, advantages, and features of the present disclosure will become apparent after review of the entire application, including the following sections: Brief Description of the Drawings, Detailed Description, and the Claims.

BRIEF DESCRIPTION OF THE DRAWINGS

The aspects and the attendant advantages of the embodiments described herein will become more readily apparent by reference to the following detailed description when taken in conjunction with the accompanying drawings wherein:

FIG. 1 is an elevational view of disassembled rifle parts secured to the breakdown rifle holder according to an embodiment of the present invention;

FIG. 2 is an elevational view of the disassembled rifle parts removed from the breakdown rifle holder;

FIG. 5 is a bottom view of the breakdown rifle holder taken in the direction of line 5-5 of FIG. 3; and FIG. 6 is a front view of the breakdown rifle holder taken in the direction of line 6-6 of FIG. 3.

DETAILED DESCRIPTION

Figure 3:
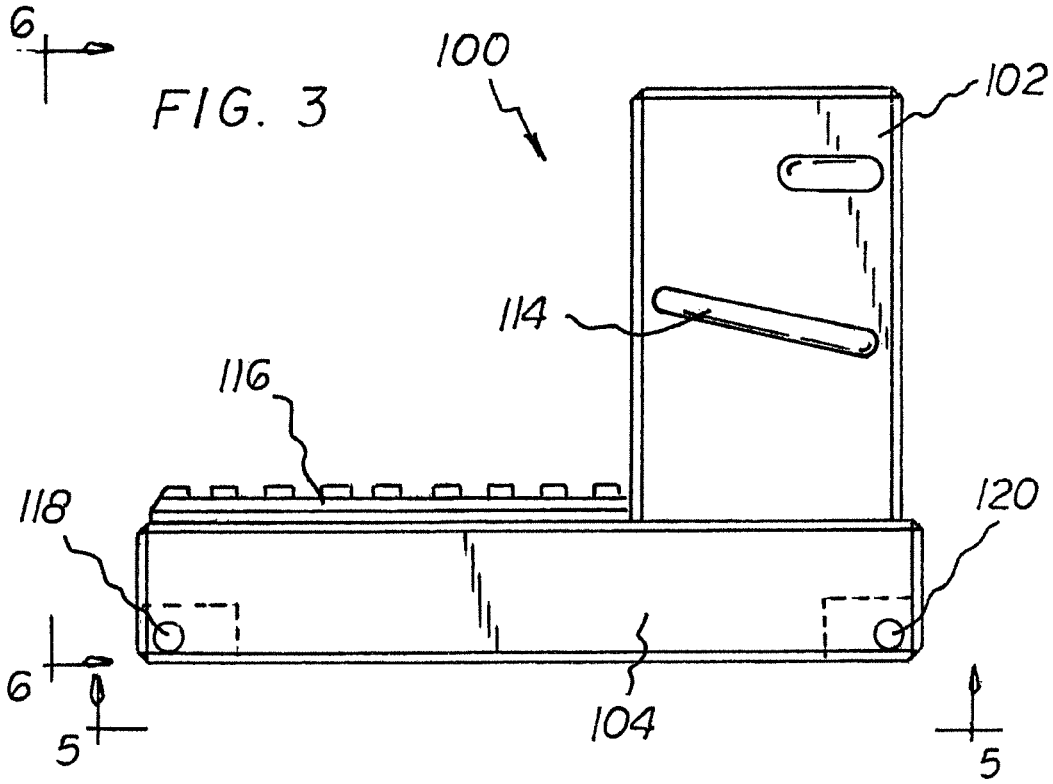
FIG. 3 is a right side elevational view of the breakdown rifle holder.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

With regard to certain of the dimensions of the breakdown rifle holder 100 illustrated in the Figures, it should be appreciated that the dimensions can be determined by careful and accurate measurement of appropriate upper and lower receivers, or by following detailed blueprints of an upper and lower receiver that may be available in the industry.

Referring initially to FIGS. 1 and 2, the breakdown rifle holder is generally designed by 100. An upper receiver 108 and a lower receiver 106 of a rifle (e.g., AR-15) are shown disassembled and being held by the breakdown rifle holder 100. A magazine 110 is also shown secured to the breakdown rifle holder 100.

The holder 100 includes an upper body 104 having an upper surface and first 130 and second notches 132 formed therein on opposing ends of the upper body 104. The first and second notches are shown in FIG. 5. The upper surface of the upper body 104 is configured to slide into the upper receiver 108 of a rifle, and the first 130 and second notches 132 each are configured to receive a respective tab 122, 124 extending from the upper receiver 108 of the rifle.

The holder 100 also includes a lower body 102 having a first end and a second end, where the first end is connected to a lower surface of the upper body 104 and extends perpendicularly away from the lower surface of the upper body 104 and forms an "L" shape. The second end of the lower body 102 is configured to slide into a lower receiver 106 of the rifle and retain the lower receiver 106 by friction fit.

In addition, a magazine receiver 116 is connected to the lower surface of the upper body 104 adjacent to the lower portion 102, where the magazine receiver 116 is configured to receive an open end of a magazine 110 and retain the magazine 110 by friction fit.

A first aperture 118 and a second aperture 120 are formed through the upper body 104 and through the first 130 and second notches 132, respectively, of the upper body 104. A first pin 126 and a second pin 128 are configured to slide through the first 118 and second apertures 120 and through first 122 and second tab apertures 124 of the upper receiver aligned with the first 118 and second apertures 120, respectively. The first 126 and second pins 128 are used to removably secure the upper receiver 108 to the upper body 104.

As will be appreciated by those having ordinary skill in the art, the terms "upper receiver" and "lower receiver" are used for basic explanation and understanding of the invention. Therefore, the terms, "upper receiver" and "lower receiver" are not to be construed as limiting the invention. It should also be appreciated that while the various exemplary embodiments of the present invention are described and shown as being utilized in connection with the an upper and lower receiver of an AR-15, they should not be construed as limiting the usage of the present invention. Thus, it should be understood that the present invention can be utilized in connection with an upper and lower receiver for any AR-15 style of rifle as well as any upper and lower receiver for any other type of rifle.

Figure 4:
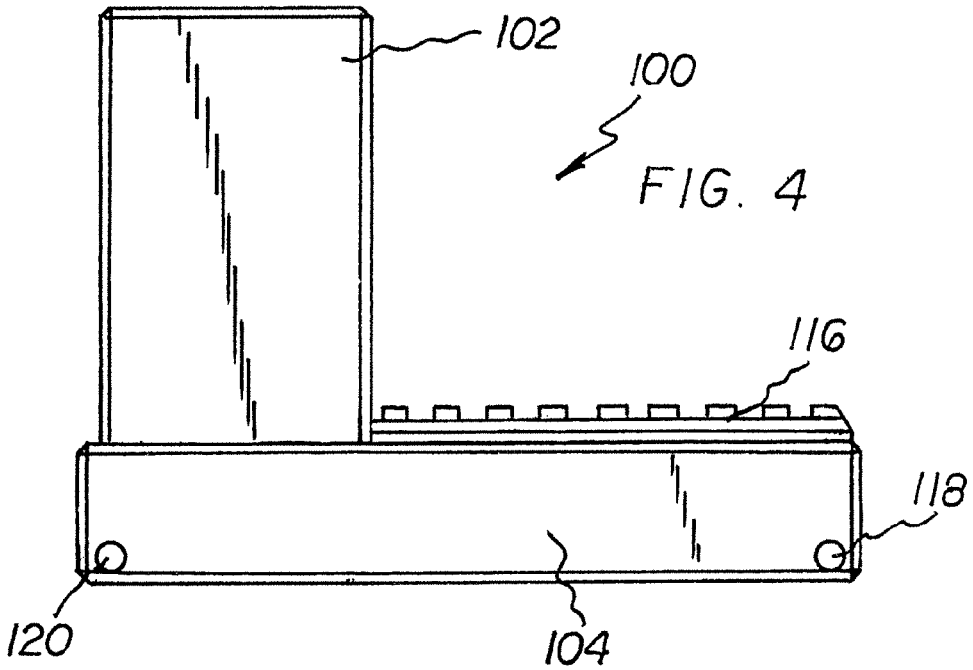
FIG. 4 is a left side elevational view of the breakdown rifle holder.

Referring now to FIGS. 3 and 4, a lower stop 114 protrudes from the right side of the lower body 102. The lower stop 114 is configured to align with a lower edge of magazine opening 112 when the lower body 102 is inserted into the lower receiver 106.

The first 130 and second notches 132 referred to above, can be seen in FIG. 5. The first 130 and second notches 132 are spaced along the upper surface of the upper body 104 to align with the upper receiver of the particular rifle being stored. Accordingly, the length of the upper body 104 and the spacing of the first 130 and second notches 132 may vary depending on the rifle characteristics.

Referring now to FIG. 6, the magazine receiver 116 is secured to the bottom surface of the upper body 104. The magazine receiver 116 may include notches/ridges along its top surface. In addition, the first notch 130 is shown in FIG. 6 that is configured to slide over the first tab 122 of the upper receiver 108.

It should be appreciated that any material that is capable of dimensional stability and durability can be utilized to construct the breakdown rifle holder 100. In various exemplary embodiments, the breakdown rifle holder 100 is formed of a plastic or polymeric material, such as a polymeric composite or a high strength plastic. Alternate materials of construction may include wood, steel, aluminum, titanium, or other metals, as well as various alloys and composites thereof.

The material should be sufficiently strong and durable as allow for longevity and tolerance. Any and all natural and man-made materials able to meet the criterion would be considered for application. Thus, it should be understood that the material or materials used to form the breakdown rifle holder 100 is a design choice based on the desired appearance or functionality of the breakdown rifle holder 100.

The previous description of the disclosed embodiments is provided to enable any person skilled in the art to make or use the disclosed embodiments. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope possible consistent with the principles and novel features as defined herein.

That which is claimed is:

1. A breakdown rifle holder for transport and storage of a rifle comprising:

an upper body having an upper surface having first and second notches formed therein on opposing ends thereof, the upper surface configured to slide into an upper receiver of the rifle, and the first and second notches each configured to receive a respective tab extending from the upper receiver; and a lower body having a first end and a second end, the first end connected to a lower surface of the upper body and extending away from the lower surface of the upper body, the second end of the lower body configured to slide into a lower receiver of the rifle and retain the lower receiver by friction fit.

2. The breakdown rifle holder of claim 1, wherein the first end of the lower body extends perpendicularly away from the lower surface of the upper body and forms an "L" shape.

3. The breakdown rifle holder of claim 2, further comprising a lower stop that protrudes from a right side of the lower body, wherein the lower stop of is configured to align with a lower edge of a magazine opening when the lower body is inserted into the lower receiver.

4. The breakdown rifle holder of claim 3, further comprising a magazine receiver connected to the lower surface of the upper body adjacent to the lower portion, wherein the magazine receiver is configured to receive an open end of a magazine.

5. The breakdown rifle holder of claim 4, further comprising a first aperture and a second aperture formed completely through the upper body and through the first and second notches, respectively, of the upper body.

6. The breakdown rifle holder of claim 5, further comprising a first pin and a second pin configured to slide through the first and second apertures and through first and second tab apertures aligned with the first and second apertures, respectively, to secure the upper receiver to the upper body.

7. The breakdown rifle holder of claim 1, wherein the upper body and the lower body comprise polymeric material.

8. The breakdown rifle holder of claim 4, wherein the magazine receiver comprises a plurality of spaced apart notches configured to secure the magazine by friction fit.

9. The breakdown rifle holder of claim 1, wherein the upper body and the lower body are sized to receive the upper receiver and the lower receiver, respectively, of an AR-15 sporting rifle.

10. A breakdown rifle holder for transport and storage of a rifle comprising:

an upper receiver of the rifle;

a lower receiver of the rifle disassembled from the upper receiver;

a magazine of the rifle removed from the lower receiver;

an upper body having an upper surface having first and second notches formed therein on opposing ends thereof, the upper surface inserted into the upper receiver of the rifle, and the first and second notches having a respective tab inserted therein from the upper receiver; and a lower body having a first end and a second end, the first end connected to a lower surface of the upper body and extending perpendicularly away from the lower surface of the upper body and forming an "L" shape, the second end of the lower body inserted into the lower receiver of the rifle in order to retain the lower receiver by friction fit.

11. The breakdown rifle holder of claim 10, wherein the first end of the lower body extends perpendicularly away from the lower surface of the upper body and forms an "L" shape.

12. The breakdown rifle holder of claim 11, further comprising a lower stop that protrudes from a right side of the lower body, wherein the lower stop of is aligned with a lower edge of a magazine opening.

13. The breakdown rifle holder of claim 12, further comprising a magazine receiver connected to the lower surface of the upper body adjacent to the lower portion, the magazine receiver inserted into an open end of the magazine and retained therein by friction fit.

14. The breakdown rifle holder of claim 13, further comprising a first aperture and a second aperture formed through the upper body and through the first and second notches, respectively, of the upper body.

15. The breakdown rifle holder of claim 14, further comprising a first pin and a second pin inserted through the first and second apertures and through first and second tab apertures aligned with the first and second apertures, respectively, and securing the upper receiver to the upper body.

16. The breakdown rifle holder of claim 10, wherein the upper body and the lower body comprise polymeric material.

17. The breakdown rifle holder of claim 13, wherein the magazine receiver comprises a plurality of spaced apart notches.

18. The breakdown rifle holder of claim 10, wherein the upper body and the lower body are sized to receive the upper receiver and the lower receiver, respectively, of an AR-15 sporting rifle.

19. A breakdown rifle holder for transport and storage comprising:

an upper body having an upper surface having first and second notches formed therein on opposing ends thereof, the upper surface configured to slide into an upper receiver of a rifle, and the first and second notches each configured to receive a respective tab extending from the upper receiver;

a lower body having a first end and a second end, the first end connected to a lower surface of the upper body and extending perpendicularly away from the lower surface of the upper body and forming an "L" shape, the second end of the lower body configured to slide into a lower receiver of the rifle and retain the lower receiver by friction fit;

a magazine receiver connected to the lower surface of the upper body adjacent to the lower portion, the magazine receiver configured to receive an open end of a magazine and retain the magazine by friction fit;

a first aperture and a second aperture formed completely through the upper body and through the first and second notches, respectively, of the upper body; and a first pin and a second pin configured to slide through the first and second apertures and through first and second tab apertures aligned with the first and second apertures, respectively, to secure the upper receiver to the upper body.

20. The breakdown rifle holder of claim 19, wherein the upper body and the lower body comprise polymeric material.

* * * * *